US006116589A

United States Patent [19]

Bortolotti

[11] Patent Number: 6,116,589

[45] Date of Patent: Sep. 12, 2000

[54] SHEET FEEDING METHOD AND ASSOCIATED DEVICE

[75] Inventor: Giuseppe Bortolotti, Yverdon-les-Bains, Switzerland

[73] Assignee: Olivetti-Lexikon S.p.A., Ivrea, Italy

[21] Appl. No.: 08/802,356

[22] Filed: Feb. 11, 1997

[30] Foreign Application Priority Data

Feb. 28, 1996 [CH] Switzerland ..... 514/96

[51] Int. Cl.[7] ..... B65H 3/52

[52] U.S. Cl. ..... 271/121; 271/117; 271/118; 271/122; 271/902

[58] Field of Search ..... 271/117, 118, 271/122, 902, 167

[56] References Cited

U.S. PATENT DOCUMENTS

| | | | |
|---|---|---|---|
| 3,815,900 | 6/1974 | Schulze | 271/118 |
| 4,606,536 | 8/1986 | Ohara | 271/118 |
| 4,717,139 | 1/1988 | Sootome et al. | 271/116 |
| 4,822,023 | 4/1989 | Miyoshi | 271/118 |
| 4,905,984 | 3/1990 | Haigh | 271/118 |
| 5,072,923 | 12/1991 | Coy | 271/118 X |
| 5,193,797 | 3/1993 | Harada et al. | 271/115 |
| 5,199,696 | 4/1993 | Kato | 271/118 X |
| 5,259,607 | 11/1993 | Hironori et al. | 271/118 X |
| 5,316,285 | 5/1994 | Olson et al. | 271/122 |
| 5,470,052 | 11/1995 | Asakawa et al. | 271/118 |
| 5,624,109 | 4/1997 | Tanaka | 271/118 X |

FOREIGN PATENT DOCUMENTS 2026848 12/1970 Germany .

OTHER PUBLICATIONS

Groenwald et al, Document Separator, IBM Technical Disclosure Bulletin, vol. 14, No. 8, 271/122, Jan. 1972.

Gibson et al, "Feed Roll Opening Mechanism", IBM Technical Disclosure Bulletin, vol. 16, No. 9, 271/122, Feb. 1974.

*Primary Examiner*—James W. Keenan
*Assistant Examiner*—Steven B. McAllister
*Attorney, Agent, or Firm*—Banner & Witcoff, Ltd.

[57] ABSTRACT

The sheet feeding device comprises a frame with a fixed receptacle for the sheets and pick-up rollers mounted on a first shaft which is pivotingly fitted on the frame by means of a rocking support device. A second shaft is linked to a motor and bears, by means of two pivotingly mounted support members, the first shaft and the rollers. Two pinions integral with the shafts and an intermediate pinion provided with a braking member allow the rollersto be brought into rotation starting from the shaft. Accordingly, the latter commands rotation of the entire support device and presses the rollers against the uppermost sheet with a surface force which increases when the resistance to movement of the uppermost sheet increases. Extremely reliable paper feeding operation is achieved as a result, with a simple construction method and at low cost.

7 Claims, 4 Drawing Sheets

10
8.
1
66
12
65
6
14
20
15
24
26
67
27
70
30
12a
22
71
75
68
21
25
7
3
42
40
74
73
5
41
2
4

SHEET FEEDING METHOD AND ASSOCIATED DEVICE

TEXT OF THE DESCRIPTION

1. Field of the Invention

The present invention concerns a method of feeding flat materials to be processed, such as sheets or envelopes, for machines using these flat materials, the materials in question being arranged in a stack on a support and taken one at a time according to a feeding direction to be fed into the said machine by means of at least one pick-up roller adapted for moving the uppermost shut of flat material of the stack and bringing it into the machine, the flat materials arranged in the stack under the uppermost flat material being retained in the stack.

2. Related Technological Art

Methods and feeding devices used in printers, typewriters or other equipment such as photocopiers are known in the current art. The known devices generally use a series of pick-up rollers fitted on an immobile drive shaft. The receptacle for the sheets then has a rear wall comprising at least one mobile part adapted for resiliently pressing the stack of sheets against the pick-up rollers. The top sheet of the stack in equipment of this type is pressed with an invariable force against the pick-up rollers, regardless of its nature and rigidity. However, it has been remarked that rigid sheets often present greater resistance to feeding movement than flexible sheets. Thus it happens that rigid sheets are frequently not fed into the machine or are fed in an inconsistent manner, giving rise to feeding and alignment problems.

SUMMARY OF THE INVENTION

The scope of this invention is to overcome these problems and at the same time to produce a device that has few components, that is simple to build at low cost and offers excellent reliability and sturdiness.

The invention is therefore characterised by the fact that a single driving mechanism is used to produce both the rotation of the roller about its axis and also a pivoting movement of the roller around a second axis parallel to the axis of the roller so that the latter may be displaced from a position in which it is away from the stack to a position where it is pressed with a surface force against the stack and vice versa, this surface force being variable and increasing as the resistance to movement in the feeding direction of the uppermost shut of flat material increases.

Thus a single mechanism provides the driving and the pivoting movement of the pick-up roller or rollers and a surface force of the rollers, and accordingly feeding of the selected sheet, all are adapted to the sheet's resistance to movement. Moreover, these characteristics are obtained from just a few components, are easy to build at low cost price and provide excellent reliability and sturdiness.

The invention also concerns a device for feeding flat materials to be processed, such as sheets or envelopes, for machines using these flat materials, comprising a frame having a support with a bottom whereupon a stack of said flat materials may be arranged and from which these flat materials are removed one at a time in a feeding direction and fed into said machine; at least one pick-up roller for moving the uppermost flat material of the stack and bringing it into the machine, said uppermost flat material of said stack showing a resistance to movement in said feeding direction; and at least one retaining member designed to retain flat materials arranged in the stack under the uppermost flat material, wherein said at least one pick-up roller is arranged on a first shaft which is pivotingly fitted on the frame by means of a rocking support device suitable for moving the first shaft from a position wherein the pick-up roller is removed from the stack to a position wherein it is pressed with a surface force against the stack and vice versa, the device comprising a driving mechanism for performing, on the one hand, rotation of the roller around said first shaft and for performing, on the other hand, pivoting movement of the rocking support device so that said surface force of the pick-up roller against the stack increases when resistance to movement in the feeding direction of the uppermost flat material of the stack increases.

Advantages offered by the device claimed are extremely simple construction, a surface force adapted to the feeding materials used, great reliability and a low cost price.

According to a preferred embodiment, the driving mechanism comprises a second shaft, rotatingly fitted on the frame and suitable for being driven by a motor, support members fitted in freely rotating manner on the second shaft and bearing the first shaft which is parallel to the second shaft, the driving mechanism so linking the two shafts that when the pick-up roller is driven in the feeding direction, the second shaft is rotated in a direction tending to press the pick-up roller against the stack and that, when the pick-up roller is driven in the opposite direction, the second shaft is rotated in a direction tending to remove the pick-up roller from the stack.

As a result, construction is particularly simple and reliable.

To advantage, the said driving mechanism comprises at least two pinions each of which rotating integrally with one of the two shafts and at least one intermediate pinion rotatingly fitted on the support members and meshing with the pinions integral with the two shafts.

These characteristics ensure precision driving and extremely sturdy construction, with very few components being employed.

The preferred embodiment of the device comprises a braking member acting on the driving mechanism.

Reliability of operation of the device is greatly enhanced as a result.

According to one advantageous variant, the device comprises a third shaft linked by kinematic means to the second shaft and bearing retractable retaining fingers intended for cooperating with the leading edge of the flat materials in order to retain the latter-named, the said third shaft being suitable for being rotated in two, opposing directions to displace the retractable retaining fingers from an active position to a retracted position and vice versa.

Safety of operation of the device is further greatly enhanced by these characteristics.

To advantage, the said linkage comprises a coupling member cooperating with command means suitable for interrupting the coupling between the second and third shaft whenever the retaining fingers are in the said active position.

Additionally, the coupling member is advantageously made of a spiral spring wound on the second shaft and comprising a first section cooperating with a pinion rotatingly fitted on the second shaft and engaged with a pinion integral with the third shaft, and a second section cooperating by means of a toothed wheel with a command lever fixed on the third shaft.

These are characteristics granting considerable simplicity of construction and operating reliability.

According to another advantageous variant, the case comprises a movable plate that defines a feeding channel with the said bottom and cooperates with the rocking support device so as to widen or contract the feeding channel.

These characteristics facilitate loading of the paper and provide precise sheet feeding operation.

Other advantages derive from the characteristics related in the associated claims and from the following detailed description of the invention, with reference to the drawings which depict schematically, and by way of example, one embodiment of the invention.

DETAILED DESCRIPTION OF THE PREFERRED EMBODIMENT

Figure 1:
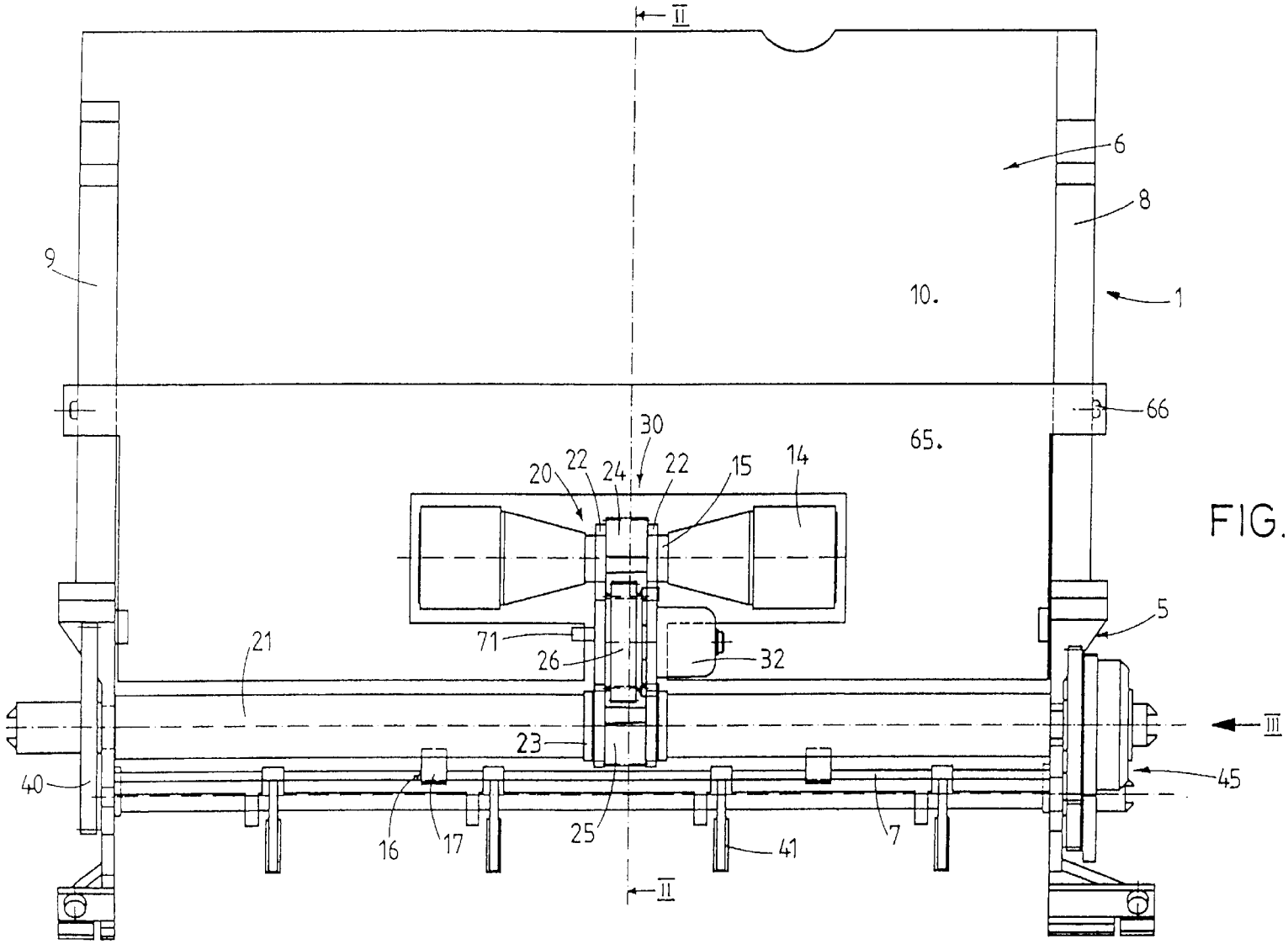
FIG. 1 is a perspective view of this embodiment.
Figure 2:
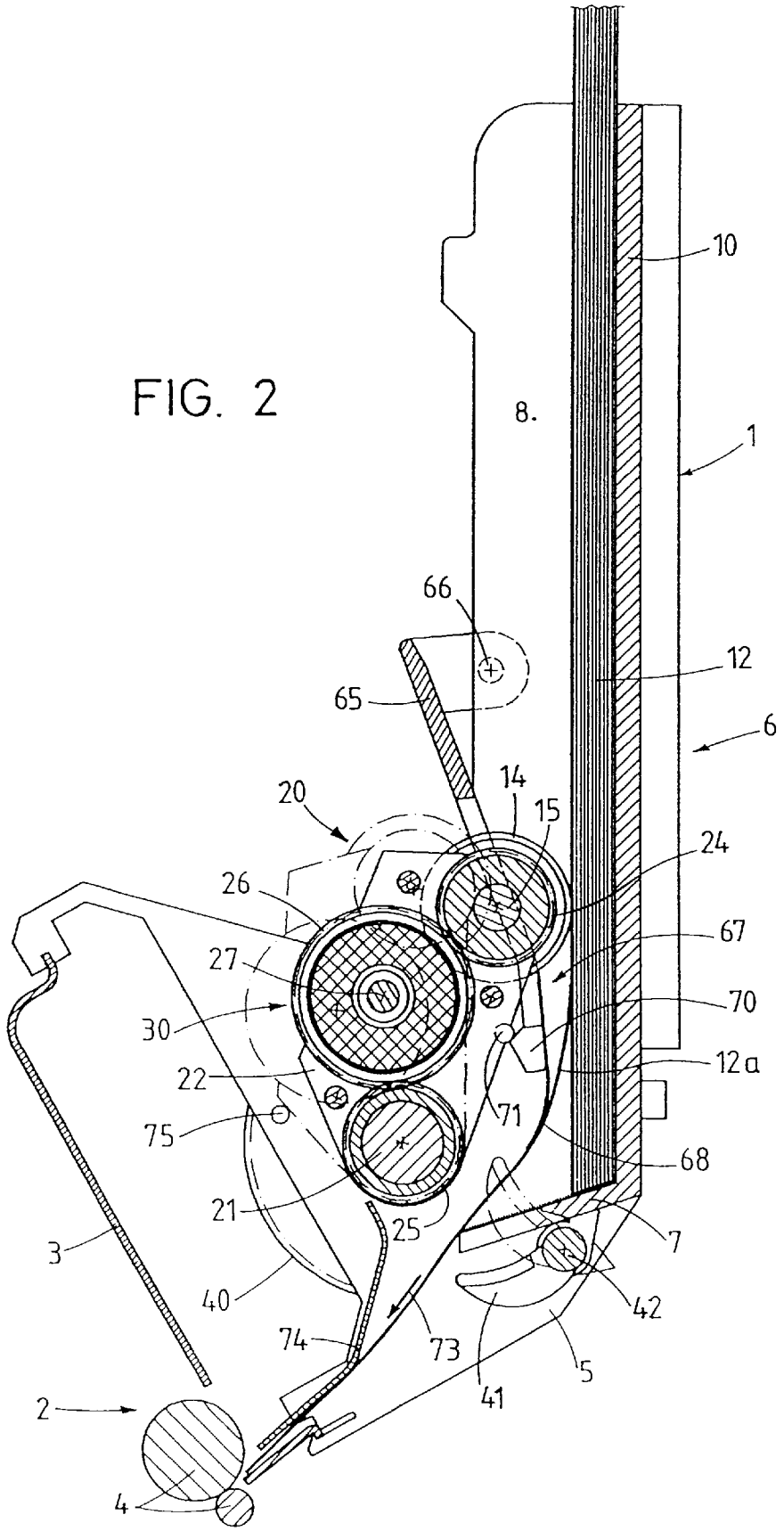
FIG. 2 is a transverse sectional view according to the line II—II of FIG. 1.
Figure 3:
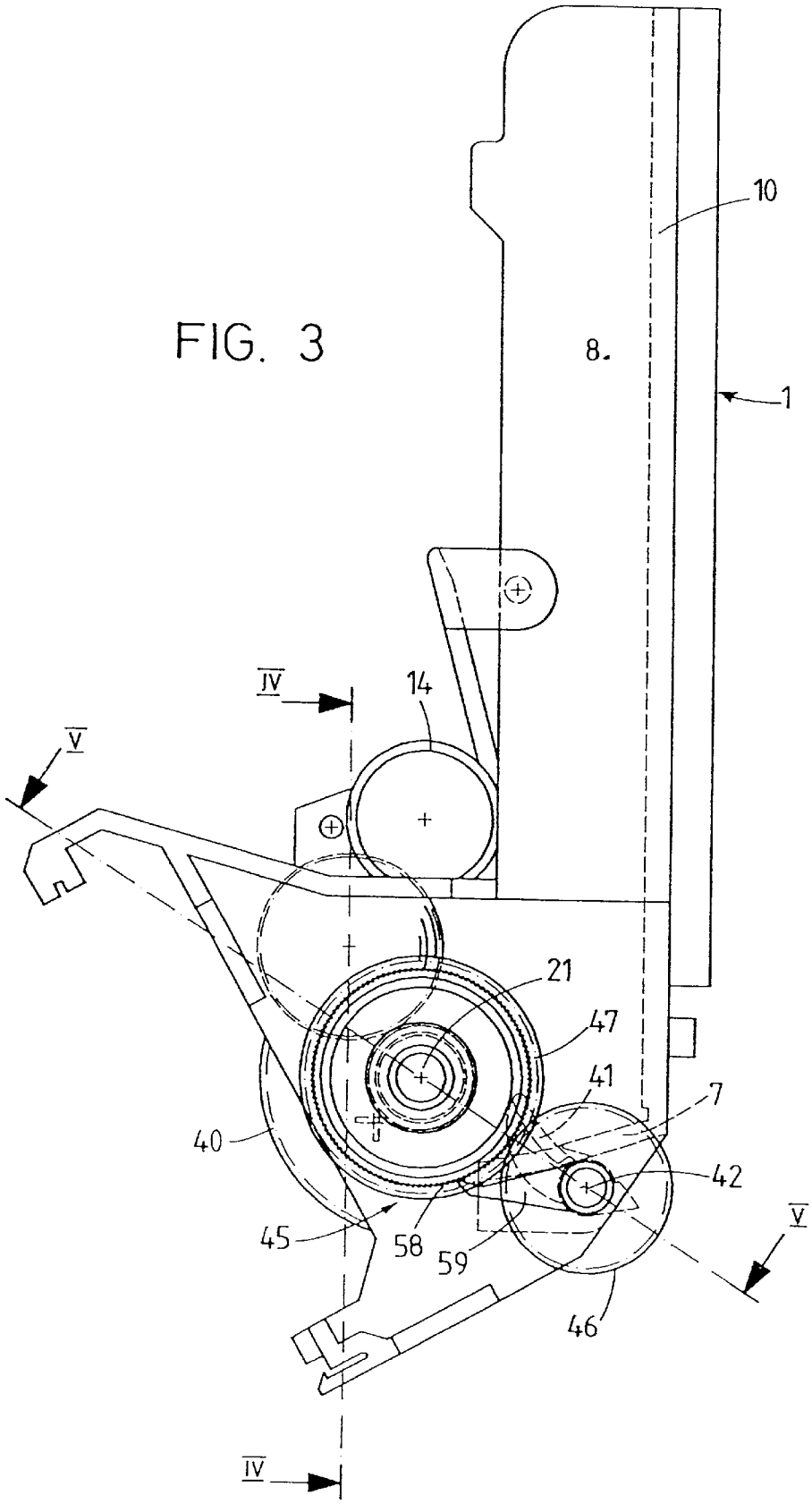
FIG. 3 is a side view according to the direction III indicated in FIG. 1.

The feeding device 1 illustrated in FIGS. 1, 2 and 3 is removably fitted on a printer 2, of which only part of the frame 3 and feeding rollers 4 are depicted. The device 1 could of course equally well be an integral part of the printer, of a typewriter or other device using these flat materials, typically paper sheets, cardboard paper or envelopes. The device 1 comprises a chassis 5 having a holder or receptacle 6 for the sheets with a front wall 7, two fixed side walls 8 and 9, and a bottom 10 on which a stack 12 of sheets, envelopes or any other kind of flat materials may be arranged.

The front wall 7 comprises indentations 16 in which strips 17 of a fibrous material, of a fabric such as velvet, have been glued. Depth of the indentations 16 is such that the top part of the fibrils of the strips 17 appears above the upper surface of the wall 7 so as to cooperate with the leading edge of the sheets or flat materials to be fed and retain these materials, the leading edge of which penetrates the strip fibrils thereby acting as retaining elements. These strips 17 present a resistance to sheet movement that is a function of the material of the fibrils used, their diameter, length and density, and of depth of penetration of the leading edge of the sheet. Strips 5 mm wide with a density of 18,000 fibrils/cm2 and 1.5 mm long provide excellent retention, whenever these fibrils exceed the top surface of the wall 7 by 0.5 mm.

The feeding device 1 comprises driving members represented by two pick-up rollers 14 designed to move the uppermost sheet 12*a* or the envelope of the stack and bring it into the printer 2. These two rollers are attached to a shaft 15 which is pivotingly fitted on the chassis 5 by means of a rocking support device 20. The latter comprises a second shaft 21 rotatingly fitted on the chassis 5 and two support elements 22 fitted in free rotating manner between two journals 23 on the central part of the second shaft 21.

The shaft 15 is rotatingly fitted on these two support members 22 and is integral with a pinion 24 located between the two support members 22.

The second shaft 21 is also rotatingly integral with a pinion 25 arranged between the two support members 22. An intermediate pinion 26 is rotatingly fitted on a shaft 27 disposed in the middle part of the two support members 22 and meshes with the pinions 24 and 25 to form a driving mechanism 30 linking the two shafts 15 and 21.

Figure 4:
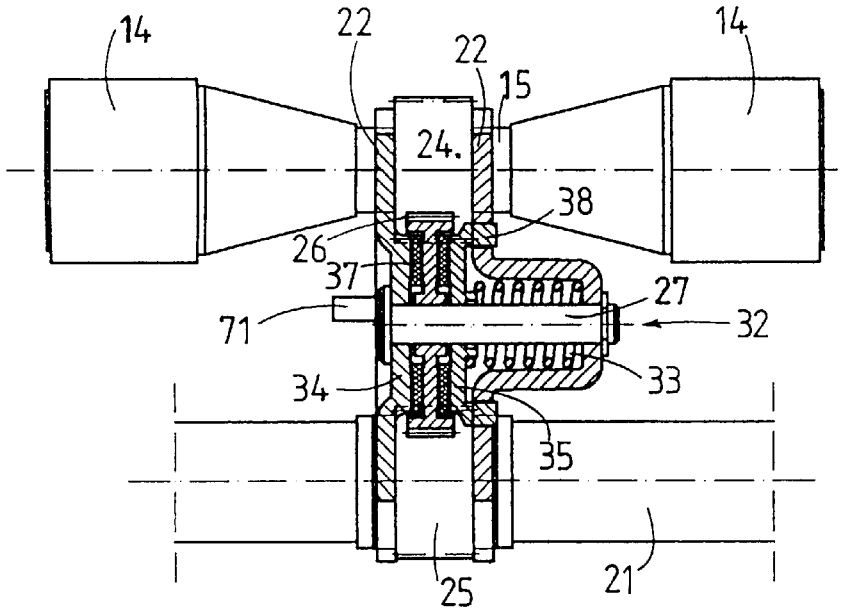
FIG. 4 is a sectional view of a detail according to the line IV—IV of FIG. 3.

A braking member 32 arranged on the support members 22 acts on the driving mechanism 30. This braking member 32 is illustrated in sectional view in FIG. 4 and comprises a helicoidal spring 33 wound around the shaft 27 of the intermediate pinion 26. This spring grips the intermediate pinion 26 with a predetermined force between a reinforcement 34 of one of the support members 22 and a disk 35 with tabs 38 preventing it from rotating. In order to obtain a suitable braking torque, the intermediate pinion 26 is equipped with liners 37, preferably of felt, intended for cooperating with the reinforcement 34 and the disk 35.

The shaft 21 is driven in two opposing directions by a motor not illustrated, which may even be that of the printer 2, meshing with a pinion 40 integral with the shaft 21. By driving this shaft 21, rotation is obtained of the rollers 14 about their shaft 15 and also pivoting movement of the rollers 14 about the shaft 21. The braking member 32 contributes to making possible or facilitating this pivoting movement of the rollers.

The feeding device also comprises retaining fingers 41 attached to a third shaft 42 pivotingly fitted to the bottom of the front wall 7. These retaining fingers 41 may be moved from a retracted position to an active position, illustrated in dashed lines in FIGS. 2 and 3, wherein they retain and, where necessary, push back the stack of sheets 12 on the receptacle 6.

Figure 5:
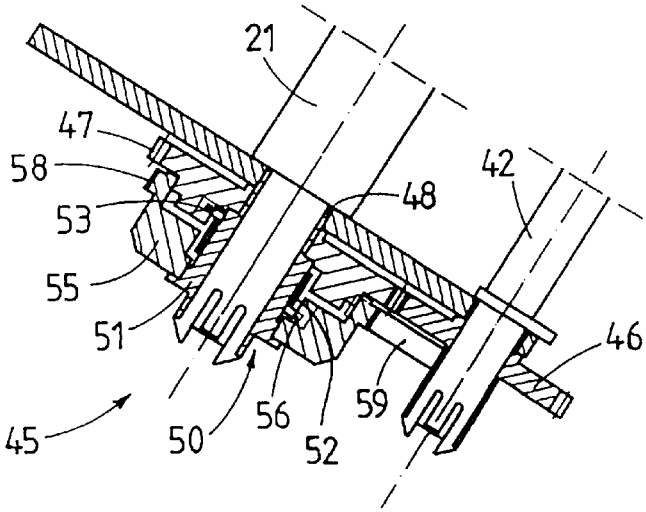
FIG. 5 is a sectional view of a detail according to the line V—V of FIG. 3.

The shaft 42 is driven to this end by the shaft 21 by means of a transmission device 45, details of which may be seen in FIGS. 3 and 5. The shaft 42 is integral with a pinion 46 meshing with the pinion 47 borne by the shaft 21, but suitable for rotating freely on a hub 48 of the latter. This pinion 47 may be made integral in rotation with the shaft 21 by means of a clutch coupling member 50. The latter comprises a ring nut 51 integral with the shaft 21 which has been provided with a helicoidal spring 52 gripping the ring nut 51. This spring 52 has a free section 53 accommodated in a niche of the pinion 47.

A lid 55 is rotatingly fitted on the ring nut 51 and retains the second free section 56 of the spring by means of a notch. This lid 55 also comprises an array of saw-teeth 58 intended for cooperating with the free end of a lever 59 attached to the shaft 42.

Operation of this transmission device 45 and of the coupling member 50 will now be explained in greater detail.

With reference to FIG. 2, the device 1 further comprises a pivoting plate 65 hinged to the side walls 8, 9 by means of pins 66. This plate 65, constituting a movable front wall for the feeding channel 67 of the sheets, is extended at its lower edge by a flexible blade 68 of a plastic material designed to suitably guide the uppermost sheet 12*a* selected. Width of the feeding channel 67 is thus variable and is determined by position of the support members 22 suitable for pivoting around the shaft 21. The lower edge of the plate 65 is accordingly equipped with a cam 70 cooperating with a protrusion 71 provided on one of the support members 22.

The device 1 operates according to the method and manner described below. When a sheet 12*a* has to be fed into the printer, the shaft 21 is put into rotation in the clockwise direction of FIGS. 2, 3 and 4. The braking member 32 then acts with a predetermined torque on the intermediate pinion 26. As a result, the entire rocking support device 20 is rotated from the position shown in dashed lines in FIG. 2 to the position shown in unbroken lines, wherein the rollers 14 are applied against the uppermost sheet 12*a*. Once rotation of the entire device 20 is terminated, the shaft 21 then sets pinions 26 and 24 in rotation. The uppermost sheet 12*a* is thus moved in the feeding direction 73 towards the printer 2.

Rotation of the entire device 20 also has the effect of narrowing the feeding channel 67, on account of the fact that the protrusion 71 pushes the plate 65 back by the cam 70. Movement of the uppermost sheet 12*a* is provided guidance by the flexible blade 68. The underlying sheets are held in place by the fibril strips 17.

When clockwise rotation of the shaft 21 begins, the shaft 42 is put in rotation in the anticlockwise direction to move the retaining fingers 41 into the retracted position illustrated in unbroken lines in FIG. 2. To do this, the ring nut 51 puts into clockwise rotation the spring 52 which in turn, by the section 53, drives the pinions 47 and 46. When the retaining fingers 41 are completely retracted and abutting against the front wall 7, the spring 52 slides on the ring nut 51, whereas feeding of the sheet 12*a* by the rollers 14 continues.

It is particularly interesting to observe that the surface force of the rollers 14 against the stack of sheets 12 increases when resistance to movement of the uppermost sheet 12*a* in the feeding direction 73 increases. This means that a rigid sheet will be more difficult to move, the rollers 14 will then be braked more, causing torque of rotation of the entire device 20 around the shaft 21 to increase, and producing a greater surface force of the rollers 14 against the stack of sheets 12. Slippage of the rollers 14 is thus effectively avoided.

When the selected sheet 12*a*, guided in its movement by a guiding and deflecting member 74, comes into contact with the feeding rollers 4 of the printer 2, the motor direction is inverted so as to put the shaft 21 in rotation in the anticlockwise direction. As a result of the action of the braking member 32, the entire device 20 is then pivoted about the shaft 21 until it comes into contact with an abutment 75 determining a disengaged position of the pick-up rollers 14. The pivoting plate 65 pressed by the flexible blade 68 then turns clockwise around the pin 66 of FIG. 2 to widen the feeding channel 67.

Similarly, the shaft 42 is turned in the clockwise direction as in FIGS. 2, 3 and 5 by the transmission device 45, so that the retaining fingers 41 are pivoted into an active position, illustrated in FIGS. 2 and 3 in unbroken lines, in which they retain and, where necessary, push back the sheets of the stack 12.

To do this, the ring nut 51 (FIG. 5) turning in an anticlockwise direction compresses the windings of the spring 52 to bring the latter into rotation. The latter sets in rotation the pinions 47, 46 and the shaft 42, on the one hand, and the lid 55, on the other hand. When the lever 59 fixed to the shaft 42 comes into contact with the teeth 58, rotation of the lid is interrupted. The section 56 of the spring 52 made immobile then opens the latter-named and driving of the pinions 47, 46 and of the shaft 42 is interrupted in the position shown in dashed lines in FIGS. 2 and 3. In this position, with the pick-up rollers 14 disengaged and the feed channel widened, it is also possible to refill the receptacle 6 with a stack of sheets.

The sheet feeding device described offers numerous advantages. It has very few components, while at the same time allowing precise control of various, distinct mechanical functions, such as engagement and disengagement of the pick-up rollers, regulation of the surface force of the pick-up rollers in function of the resistance to feeding movement, regulation of width of the aperture of the feeding channel and two-way action of the sheet retaining members. A single driving mechanism is used in the method and in the device for producing, on the one hand, rotation of the rollers about their shaft and for producing, on the other hand, the pivoting movement of the rollers around the shaft 21, so as to press the rollers against the stack or move them away from the stack. In addition, a single inversion of the direction of feed of the device is sufficient for all these functions to be achieved. Being so simple to build, cost price is low while at the same time excellent reliability and safety of use are guaranteed, together with exceptional sturdiness.

It is clear that the embodiment described in the foregoing possesses no limiting traits and that all the changes desired may be made to the interior of the frame as defined in claim 1. In particular, the rocking support device 20 could be made much differently. In place of a second shaft 21, this device 20 could have two levers in the shape of pins on the side walls 8, 9. The shaft of the rollers could be driven by means of one or two belts. The number of rollers need not necessarily be two and the latter could in fact be replaced by any other driving member, such as a cylinder. The braking member could be dispensed with, or built differently. Command of the retaining fingers could be produced by any other form of driving, meshing or clutching.

What is claimed is:

1. A feeding device provided for feeding flat materials, to a machine in which said flat materials will be processed, comprising:

a frame having a holder with a bottom whereupon a stack of said flat materials may be arranged and from which these flat materials may be removed one at a time in a feeding direction and fed into said machine;

at least one pick-up roller for moving the uppermost sheet of flat material of the stack and for bringing it into the machine; and at least one retaining member designed to retain flat materials arranged in the stack under the uppermost sheet of flat material, said at least one pick-up roller being arranged on a first shaft which is pivotingly fitted on the frame by means of a rocking support device suitable for moving the first shaft from a position in which the pick-up roller is removed from the stack to a position in which it is pressed with a surface force against said stack and vice-versa, the rocking support device comprising a driving mechanism for performing, on the one hand, rotation of the roller around said first shaft and for performing, on the other hand, pivoting movement of the rocking support device so that said surface force of the pick-up roller against the stack increases when resistance to movement in the feeding direction of the uppermost flat material of the stack increases, wherein the improvement consists in that said at least one retaining member comprises retractable retaining fingers, in which said at least one retaining member comprises a third shaft bearing said retractable retaining fingers and having a kinematic linkage with said second shaft, said retractable retaining fingers cooperating with the leading edge of said flat materials for retaining the latter, said third shaft being suitable for being turned in two opposing directions to move said retractable retaining fingers from an active position to a retracted position and vice versa.

2. A device according to claim 1, wherein said kinematic linkage comprises a coupling member cooperating with command means suitable for interrupting said coupling between said second and said third shaft when said retaining fingers are in said active position.

3. A device according to claim 2, wherein said coupling member is constituted by a spiral spring wound on said second shaft and comprising a first section cooperating with a first pinion rotatingly fitted on said second shaft and meshing with a second pinion integral with said third shaft, and a second section cooperating by means of a toothed wheel with a command lever attached to said third shaft.

4. A device according to claim 1, wherein said holder comprises a movable plate, said movable plate defining with side walls and said bottom of said holder a feeding channel, and cooperating with said rocking support device so as to widen or narrow said feeding channel.

5. A device according to claim 4, in which said movable plate has a top part and a bottom part, wherein said movable plate is pivotingly mounted on said frame essentially by said top part and comprises a cam fitted to said bottom part so as to cooperate with a cam follower integral with said rocking support device.

6. A method for feeding flat materials to be processed, for machines using said flat materials, comprising the steps of:

arranging said flat materials in a stack on a holder, taking said flat materials one after another in a feeding direction for feeding into said machine by means of at least one pick-up roller, rotatable around a first shaft and pivotable around a second shaft parallel to said first shaft, said pick-up roller being arranged for moving an uppermost sheet of flat material of said stack to bring it into said machine, said uppermost sheet of flat material of said stack showing a resistance to movement in said feeding direction, arranging said flat materials in said stack under said uppermost sheet of flat material being retained in said stack by retaining means cooperating with a leading edge of said flat materials, using a single driving mechanism for producing, on the one hand, a rotation of said at least one pick-up roller around said first shaft, and for producing, on the other hand, a pivoting movement of said roller around said second shaft so as to move said at least one pick-up roller from a first position, wherein it is removed from said stack to a second position, wherein it is pressed with a surface force against said stack and vice-versa, said surface force being variable and increasing as said resistance to movement in said feeding direction of said uppermost sheet of flat material of said stack increases, wherein the improvement comprises the step of defining a feeding channel with a movable plate by the use of said holder, wherein said pivoting movement of said at least one pick-up roller is used to act with said movable plate so as to widen or narrow said feeding channel.

7. A method according to claim 6, in which said machine comprises a driving mechanism having members for driving said at least one pick-up roller, said pivoting movement being obtained or facilitated by braking of one of said members of said driving mechanism, and in which said retaining means comprises retractable retaining fingers, wherein said driving mechanism is used for command of said retractable retaining fingers cooperating with said leading edge of said flat materials in order to retain them on said holder.

* * * * *